United States Patent [19]

Attey

[11] Patent Number: 4,825,793

[45] Date of Patent: May 2, 1989

[54] SAILBOARD BOOM END FITTING AND SAILBOARD BOOM SYSTEM

[76] Inventor: Graeme S. Attey, 1 Pamment Street, North Fremantle, Western Australia, 6159, Australia

[21] Appl. No.: 98,454

[22] Filed: Sep. 18, 1987

[30] Foreign Application Priority Data

Sep. 19, 1986 [AU] Australia ..... PH8090
Jan. 27, 1987 [AU] Australia ..... PI0043

[51] Int. Cl.[4] ..... B63B 15/00
[52] U.S. Cl. ..... 114/98; 114/39.2
[58] Field of Search ..... 114/39.2, 89, 90, 92, 114/98, 99

[56] References Cited

U.S. PATENT DOCUMENTS 4,424,759 1/1984 Dolence ..... 114/98
4,674,428 6/1987 Weber ..... 114/98

FOREIGN PATENT DOCUMENTS

86/00082 1/1987 PCT Int'l Appl. .

*Primary Examiner*—Joseph F. Peters, Jr.
*Assistant Examiner*—Jesus D. Sotelo
*Attorney, Agent, or Firm*—Reising, Ethington, Barnard, Perry & Milton

[57] ABSTRACT

The present invention relates to a sailboard boom front end fitting and a sailboard boom equipped with the subject front end fitting, which fitting comprises a central flexible member flanked by a pair of shoulders, a recess defined by the central member and shoulders and having a front facing gap, the front facing gap being openable by leverage exerted by the boom arms to enable the fitting to be presented sideways to a mast and being closable by leverage exerted by the boom arms so that the front end fitting firmly grips the mast.

12 Claims, 8 Drawing Sheets

SAILBOARD BOOM END FITTING AND SAILBOARD BOOM SYSTEM

The present invention relates to a sailboard boom end fitting and sailboard boom system.

Sailboard booms typically comprise a front end and a clew end interconnected by a pair of boom arms. The boom arms are connected together at the clew end by a suitable means and at the front end by a fitting.

In the past front end fittings have taken a number of forms. For example, in most arrangements, ropes are used to attach the boom to a mast of a sailboard.

More recently, a front end fitting known as "the link" uses a split cup which is squashed onto the mast by direct frictional pressure from the boom arms.

There has also been proposed "the Bost fitting" which connects two half cups at the front and squeezes onto the mast by a thick rubber pad. The half cups are connected at the rear through a buckle.

There have also been a number of front end fittings which replace ropes with buckles and/or cams.

A well known prior art front end fitting is that found in "the Push boom" which utilises sail tension to push the boom onto the back of the mast. However, in practice, the push boom also requires the assistance of, for example, ropes or buckles, to prevent it from slipping on the mast. One version of the Push Boom is the Bartholin end which is the subject of International Patent Application No. PCT/DK86/00082 (WO87/00503). However, the Bartholin end suffers from a number of disadvantages. For example, the Bartholin end relies on sail tension and sailor weight alone to grip the mast. Further, the Bartholin end must be slid up and down the mast to attach it to or remove it from the mast.

The prior art front end fittings for sailboard booms have thus suffered from a number of disadvantages and have only partially achieved the aim of effectively and efficiently gripping the mast.

In accordance with one aspect of the present invention there is provided a sailboard boom having a front end and a clew end, a pair of boom arms interconnecting the front end and the clew end, the clew end having a clew end fitting comprising two parts which are clipped together, in use, but which are capable of being unclipped and the front end comprising a front end fitting which comprises a central flexible arcuate web or pivot mechanism and a pair of shoulders on respective sides of the web, the web and shoulders defining a recess arranged to receive a sailboard mast, said shoulders defining between them a front facing gap, a pair of stub shafts projecting rearwardly from respective shoulders and diverging outwardly away from the shoulders so as to engage in respective adjacent ends of the boom arms.

In accordance with another aspect of the present invention there is provided a sailboard boom substantially as hereinbefore described with reference to the accompanying drawings.

The present invention will now be described, by way of example, with reference to the accompanying drawings, in which.

Figure 2:
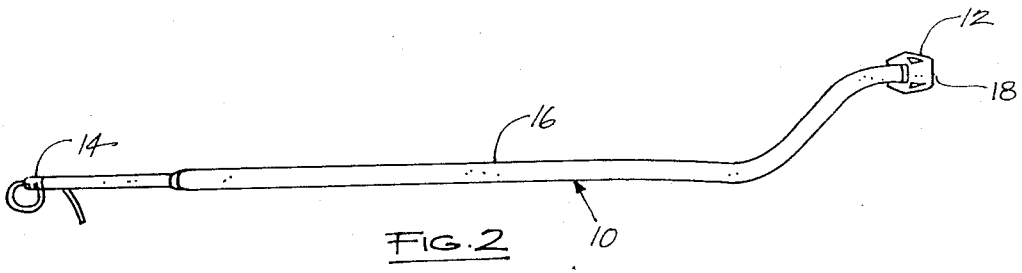
FIG. 2 is a side elevation of the sailboard boom of FIG. 1.
Figure 1:
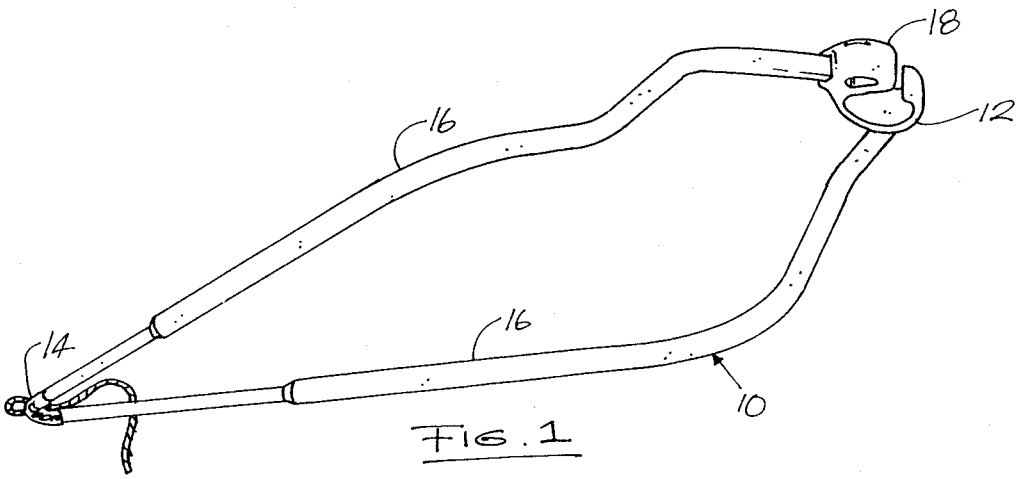
FIG. 1 is a lower perspective view of a sailboard boom in accordance with the present invention.

In FIGS. 1 and 2, there is shown a sailboard boom 10 comprising a first, front end 12 and a second, clew end 14. The first and second ends 12 and 14 of the boom 10 are interconnected by a pair of boom arms 16. As can be seen in FIG. 1, the boom arms 16 are bowed outwardly between the first and second ends 12 and 14 on opposite sides of an axial line extending between the first and second ends 12 and 14. The configuration of the boom arms 16 shown in FIGS. 1 and 2 is the subject of Australian Patent Application No. 28861/84 and corresponding applications in other countries. However, it is to be understood that the front end fitting of the present invention to be described can also be used with conventional "flat" sailboard booms. The boom .arms 16 are detachably clipped together at the second clew end 14 by means to be described. Further, the boom arms 16 are connected together at the first, front end 12 by means of a front end fitting 18 which will be described in detail hereinafter.

Figure 4:
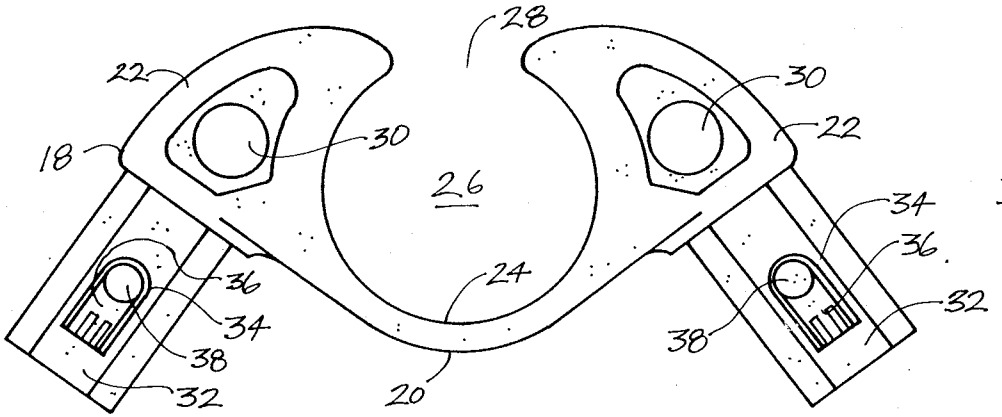
FIG. 4 is a plan view of the front end fitting of Figure 3.
Figure 3:
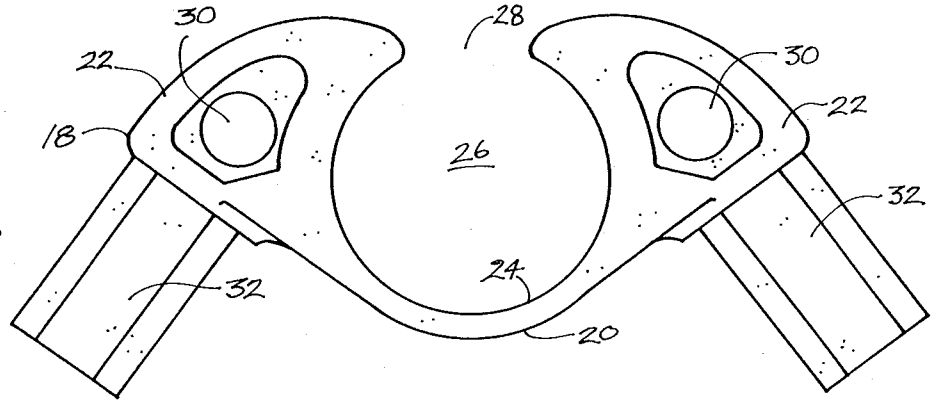
FIG. 3 is an underneath view of the front end fitting of the sailboard boom of FIGS. 1 and 2.
Figure 5:
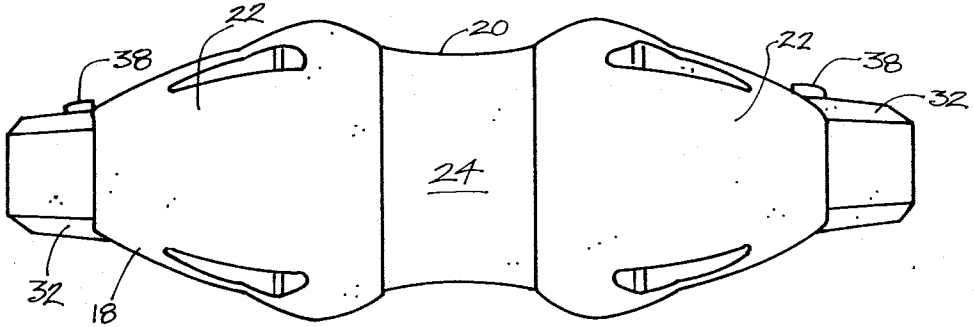
FIG. 5 is a front elevation of the front end fitting of FIG. 3.

The front end fitting 18 is shown in detail in FIGS. 3 to 8 of the accompanying drawings. It is to be understood that the front end fitting of FIGS. 3 to 8 can be used in inverted condition from that shown in FIGS. 3 to 8. In FIGS. 3 to 8, there is shown a front end fitting 18 for a sailboard boom which fitting 18 is formed in a single piece from plastics material. The fitting 18 comprises a central flexible web 20 which is flanked by a pair of shoulders 22. As can be seen in FIGS. 3 and 4 the web 20 is generally arcuate in plan. Further, the web 20 and the shoulders 22 in combination have a flush generally part circular (when the front end fitting 18 is unstressed) inner wall 24 which defines a recess 26. The recess 26 has a front facing gap 28 between the foremost ends of the shoulders 22. Further, as can be seen in FIGS. 3 and 4 each shoulder portion contains a generally upright aperture 30. The apertures 30 reduce the weight of the front end fitting 18 and can have uphaul ropes of known type passed through thereto.

Still further, a respective stub shaft 32 projects rearwardly from each shoulder portion 22. As can best be seen in FIG. 6 each stub shaft 32 is non-circular in transverse cross-section and in the embodiment shown is generally square. Preferably, however, the corners of the profile are chamfered or radiused to avoid having sharp edges in the stub shafts 22. The generally square profile is preferred as the leading ends of the boom arms 16 can be configured to this shape by known techniques quite readily. Further, the non-circular profile helps prevent relative rotational movement between the stub shaft 32 and the arm 16 as will be described. The stub shafts 32 could have a pentagonal or hexaganol transverse profile but in this case the faces between corners would preferably be concave to assist in preventing the relative rotational movement described above.

Figure 8:
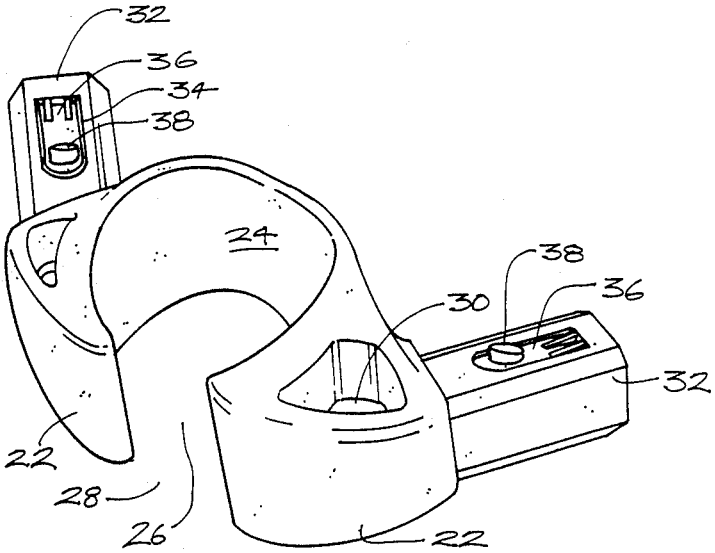
FIG. 8 is an upper perspective view of the front end fitting of FIG. 3.

As can be seen in FIGS. 4 and 8, the shafts 32 are each formed with an elongated shallow recess 34 extending longitudinally of the shaft 32. Each recess 34 has mounted therein a resilient tab 36 which is mounted to a wall of recess 34 adjacent the free end of the stub shaft 32 remote from the shoulder portion 22 and is spaced from the floor of the recess 34. At its end remote from the free end of the stub shaft 32 the tab 36 is provided with an outwardly facing button 38.

Figure 9:
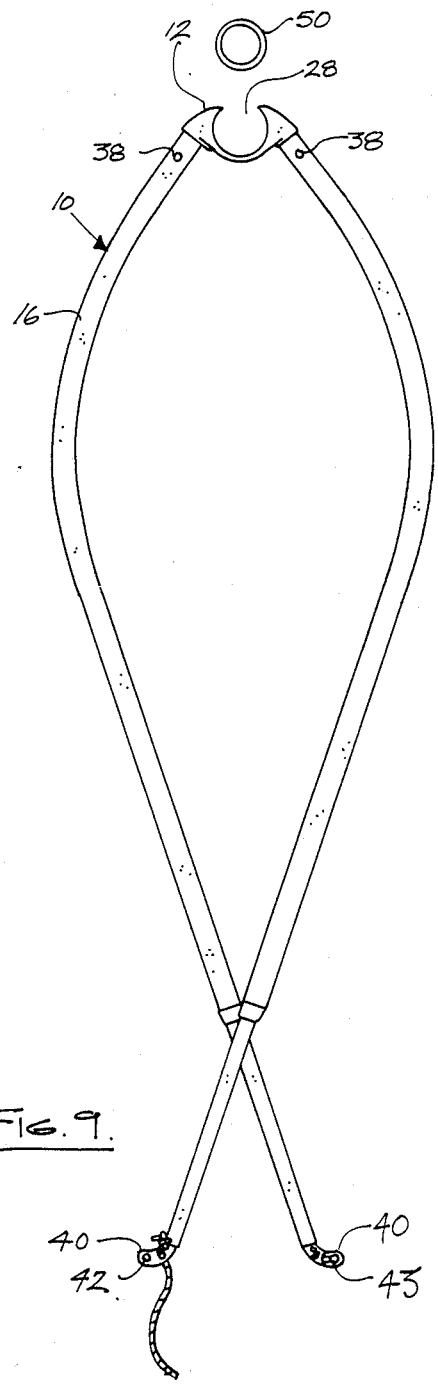
FIG. 9 is a plan view of the sailboard boom of FIGS. 1 and 2 showing the unstressed orientation of boom arms thereof with a clew end of the sailboard boom unclipped.
Figure 10:
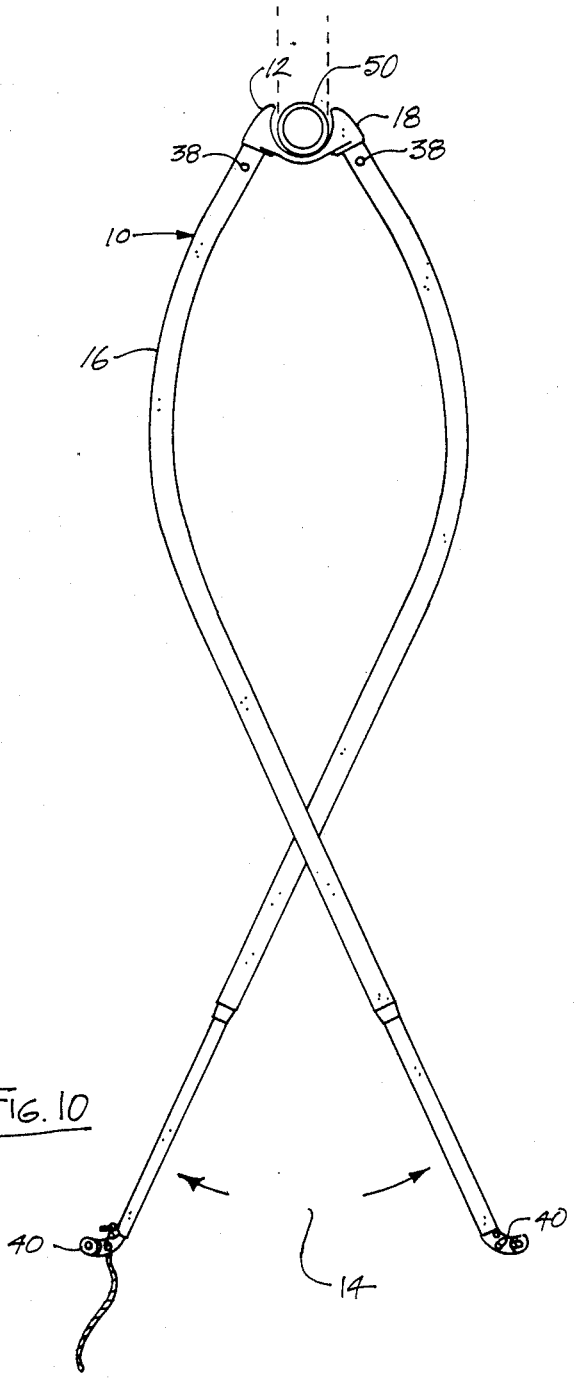
FIG. 10 is a view similar to FIG. 9 showing the orientation of the boom arms when the front end fitting is opened up to present it to a mast for attachment thereto.
Figure 11:
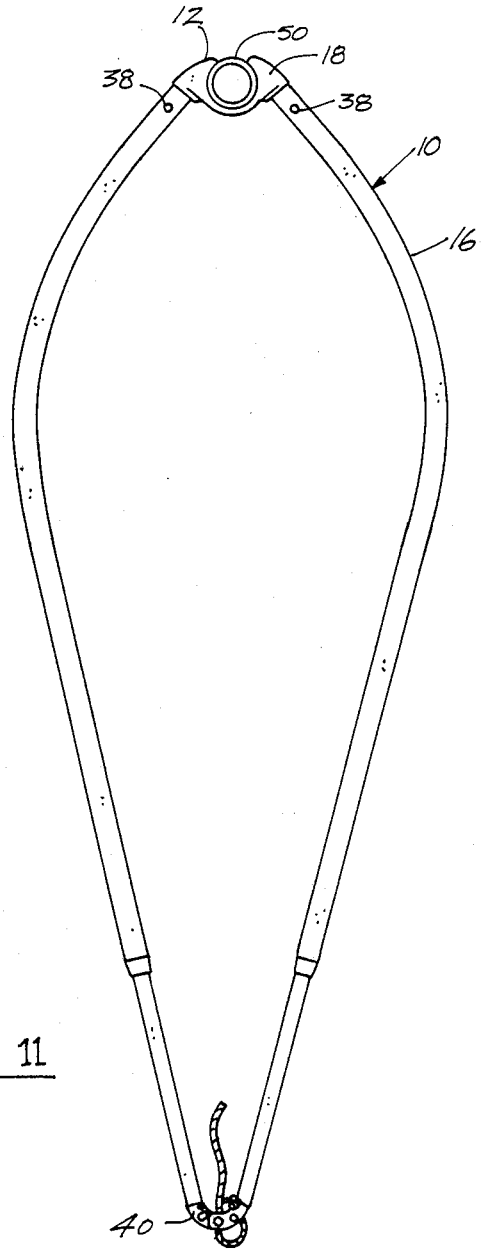
FIG. 11 is a view similar to FIGS. 9 or 10 showing the sailboard boom attached to a mast and the clew end clipped together such that the sailboard boom is ready for use.

As can be seen in FIGS. 9 to 11, the boom 10 comprises a pair of boom arms 16 of tubular form which are conveniently formed of metal alloy or composite material. The front ends of the arms 16 are shaped to fit snugly over the stub shafts 32. For example, the front ends of the arms 16 may conveniently be made generally square by known techniques whilst the remainder of the boom arm 16 retains a generally circular profile. Each boom arm 16 contains an aperture which is arranged to engage with the button 38 of the stub shaft 16.

The clew ends of the boom arms 16 are formed with respective laterally extending spaced pairs of lugs 40. One of the lugs 40 of each pair comprises an aperture 42 whilst the other lug 40 of the pair is formed with a button 43 which is similar to the buttons 38 described above. The lugs 40 are arranged to be clipped together by interdigitation of the pairs such that the aperture 42 each pair becomes engaged with a corresponding button 43 of the other pair.

Figure 12:
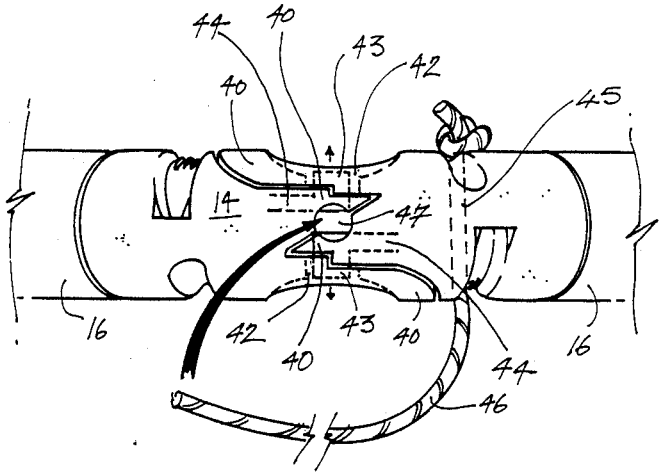
FIG. 12 is a rear view of the clew end of the sailboard boom of FIGS. 1 and 2 clipped together.

This construction of the clew end 14 is shown in more detail in FIG. 12. As shown in FIG. 12 the buttons 43 are mounted on the ends of resilient tabs 444 to enable the buttons 43 to be depressed as the pair of lugs 40 are interdigitated and then to spring out into engagement with the apertures 42 to engage the pairs of lugs 40 together. Further, one of the boom arms 16 may have a clew end 14 provided with an aperture 45 through which a rope 46 may be threaded. The rope 46 may be screwed at one end by being chamfered as shown in FIG. 12. Further, when the lugs 40 are engaged together there is an aperture 47 extending through the clew end 14 which aperture 47 is arranged to receive the rope 46. The rope 46 thus may be then reached through the aperture 47 to firmly secure the lugs 40 together and then tied to a convenient adjacent member such as a boom arm 16.

Figure 6:
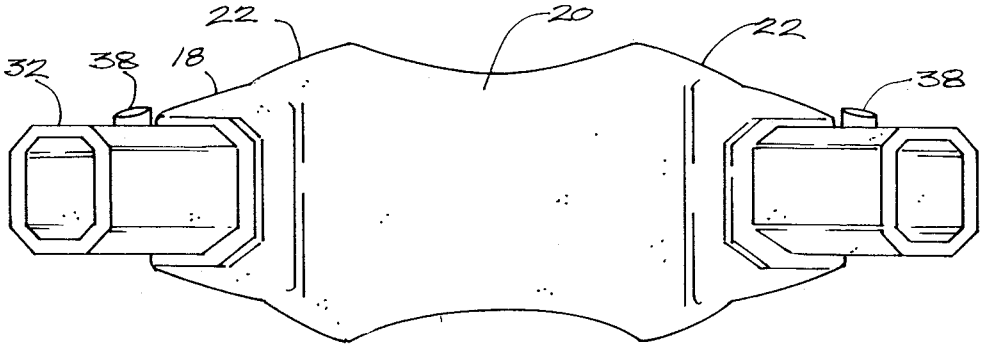
FIG. 6 is a rear elevation of the front end fitting of FIG. 3.
Figure 7:
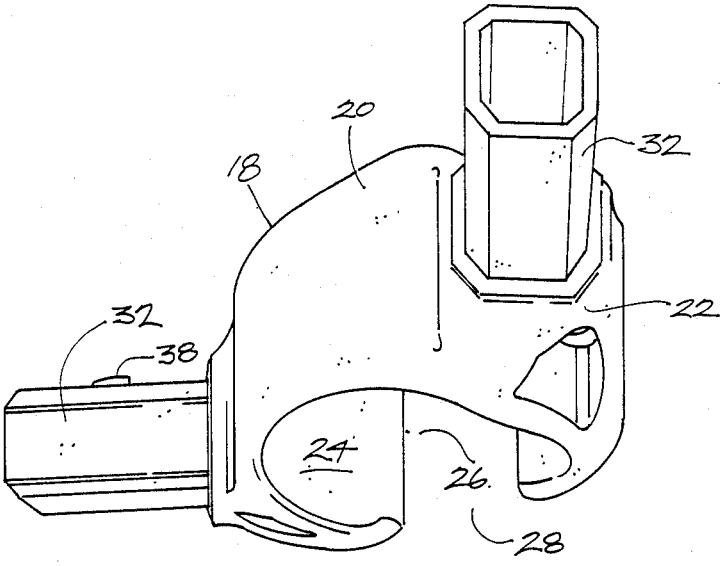
FIG. 7 is a lower perspective view of the front end fitting of FIG. 3.

In use, the boom arms 16 are engaged with the fitting 18 by pushing the front ends of the boom arms 16 onto respective stub shafts 32. As can be seen in FIG. 6, the buttons 38 have ramped free ends so that as each boom arm 16 is pushed onto a stub shaft 32 the boom arm 16 pushes the button 38 downwardly against the resilience of the tab 36. When the corresponding aperture in the front end of the boom arm 16 comes into alignment with the button 38 the latter is then urged outwardly by the tab 36 so that the button 38 engages with the corresponding aperture in the boom arm 16. In this way, the boom arm 16 and the stub shaft 32 are firmly but detachably secured together.

In the unstressed condition of the boom 10 with the boom arm 16 connected to respective stub shafts 32 with the second clew end 14 unclipped the boom arms 16 cross over one another adjacent the second clew end 14 as shown in FIG. 9. In this position, the gap 28 is too small to enable the fitting 18 to be presented sideways to a mast 50 of a sailboard.

However, the gap 28 can readily be opened up by simply manually moving the clew ends of the boom arms 16 outwardly as shown by the arrows shown in FIG. 10.

In this operation, the leverage exerted by the boom arms 16 is used to flex the resilient web 20 of the fitting 18 so as to move the shoulder portions 22 away from one another. In this condition, the gap 28 is sufficiently wide to enable the fitting 18 to be presented sideways to the mast 18 and for the recess 26 to engage with the mast 50 as shown in FIG. 10. Then the clew ends of the boom arms 16 can be released to enable them to return to substantially the position shown in FIG. 9. In this position, the gap 28 is closed up by the shoulders 22 approaching one another until the wall 24 engages with the mast 50. Further in this position, the clew ends of the boom arms 16 are still crossed as shown in FIG. 9.

Subsequently, the clew ends of the boom arms 16 are manually pulled together so as to enable the lugs to be engaged with one another and the apertures 42 to be aligned so that the pin can then secure the clew ends together. This movement urges the fitting 18 into firm engagement with the mast 50 because the leverage exerted by the boom arms 16 exerts considerable pressure on the shoulders 22. Usually, there would be a resilient high friction co-efficient pad of known type, formed of for example, soft rubber or foam, inserted between the fitting 18 and the mast 50. This resilient pad would be squeezed between the fitting 18 and the mast 50 which would ensure an even more firm engagement to assist in preventing slippage on the mast.

To engage the boom 10 with a sailboard it is preferred to have the sail in place first. However, this is no problem since one of the boom arms 16 can be disengaged from its stub shaft 32 by simply depressing the button 38 and then pulling the boom arm 16 off the stub shaft 32. The fitting 18 is placed just to the rear of the mast 50 with the remaining boom arm 16 extending along a first side of the sail. Subsequently, the detached boom arm 16 is placed along the opposite side of the sail and then pushed onto the stub shaft 32 over the button 38 until the button 38 engages with the corresponding recess in the boom arm 16 as described above. Thus, connection of the boom 10 to a sailboard is a simple task.

As can be seen in FIG. 11, the front ends of the boom arms 16 are so orientated that the innermost edges of the boom arms 16 lie along tangents to the mast 50. Further, the front end fitting 18 typically extends around at least 70% of the circumference of the mast 50 such as from 70 to 90%. This construction enables the front ends of the boom arms 16 to push towards each other around the front of the mast 50 pulling against the web 20.

Still further, the percentage opening for the front of the mast 50 when viewed from the front when in the condition shown in FIG. 11 is preferably in the range from 30 to 80% such as about 56% of the periphery of the mast.

With the construction shown the more force a sailor exerts on the boom 10, the tighter the fitting 18 grips the mast 50.

Further, sail tension pushes the web 20 onto the mast 50 providing extra tension and force onto the mast.

With the construction of the present invention sufficient grip is exerted on the mast 50 to avoid any requirements for additional securing means such as ropes. The sympathetic forces of the sail and sailor mentioned above augment the grip on the mast 50.

The non-circular shape of the stub shafts 32 and the corresponding portions of the boom arms 16 help prevent twist and avoids load being placed on the buttons 38. Modifications and variations such as would be apparent to a skilled addressee are deemed within the scope of the present invention. For example, the web 20 could be replaced by a member having a hinge or the like so as to provide a pivot mechanism between the shoulders 22.

I claim:

1. A sailboard boom assembly having a front end and a clew end, a pair of boom arms interconnecting the front end and the clew end, the clew end having a clew end fitting comprising tow parts which are clepped together in use, but which are capable of being unclipped and the front end comprising a front end fitting having a stressed and unstressed condition which comprises a central flexible arcuate web and pair of shoulders on respective sides of the web, the web and shoulders defining a recess arranged to receive a sailboard mast, said shoulders defining between them a front facing gap, a pair of stub shafts integral with and projecting rearwardly from respective shoulders and diverging outwardly away from the shoulders so as to engage in respective adjacent ends of the boom arms, said stub shafts being immovable with respect to said shoulders, said assembly characterized by said front end fitting being in said stressed condition when said clew end fitting is clipped together for securing said front end fitting to the mast.

2. A sailboard boom according to claim 1, in which when the clew end fitting is unclopped, and the front end fitting is unstressed, the boom arms cross over one another.

3. A sailboard boom according to claim 2, in which the boom arms can be crossed over one another to a greater extent by moving the crossed clew ends further apart and flexing the web of the front end fitting so as to increase the size of the front facing gap.

4. A sailboard boom according to claim 1 in which at least one of the boom arms is detachably secured to its stub shafts.

5. A sailboard boom according to claim 1, in which the stub shafts are non-circular in cross-section and the corresponding forward ends of the boom arms having a corresponding shape in cross-section.

6. A sailboard boom as claimed in claim 1, in which the front ends of the boom arms are so orientated that the innermost edges of the boom arms lie along tangents to a mast engaged in the recess of the front end fitting when the clew end fitting is clipped together.

7. A sailboard boom as claimed in claim 1, in which the front end fitting extends around from about 70% to 90% of the periphery of a mast received in the recess of the- front end fitting when the clew end fitting is clipped together.

8. A sailboard boom as claimed in claim 1, in which the percentage opening, when viewed from the front, for the front of a mast received in the recess of the front end fitting when the clew end fitting is clipped together, is in the range from about 30 to 80% of the periphery of the most.

9. A front end fitting for a sailboard boom having a stressed and unstressed condition, which fitting comprises a central flexible web and a pair of shoulders flanking the web, the web and shoulders defining a recess arranged to effect securement to a mast of a sailboard in the stressed condition, the recess having a front facing gap between inner ends of the shoulders, and a pair of stub shafts integral with and projecting rearwardly from respective shoulders and diverging outwardly away from the fitting.

10. A front end fitting according to claim 9, in which the stub shafts are of non-circular transverse cross-section.

11. A front end fitting according to claim 9, which is formed in a single piece from plastics material.

12. A front end fitting according to claim 9, in which at least one of the stub shafts comprises a resiliently mounted button arranged to be depressed to allow a boom arm to be engaged with the stub shaft and to spring outwardly into engagement with a corresponding aperture on the boom arm so as to retain the latter in place.

* * * * *